US006322391B1

(12) United States Patent
Kodama

(10) Patent No.: US 6,322,391 B1
(45) Date of Patent: Nov. 27, 2001

(54) DOUBLE LOCKING CONNECTOR

(75) Inventor: Shinji Kodama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/655,405

(22) Filed: Sep. 5, 2000

(30) Foreign Application Priority Data

Sep. 6, 1999 (JP) ..... 11-251425

(51) Int. Cl.[7] ..... H01R 13/40
(52) U.S. Cl. ..... 439/595; 439/752
(58) Field of Search ..... 439/595, 750, 439/751, 752, 744

(56) References Cited

U.S. PATENT DOCUMENTS 4,946,399 * 8/1990 Kawashima ..... 439/752
5,085,599 * 2/1992 Maejima et al. ..... 439/595
5,167,534 * 12/1992 Ohsumi ..... 439/595
5,358,427 * 10/1994 Miwa ..... 439/595
5,810,619 * 9/1998 Miwa ..... 439/595
6,089,928 * 7/2000 Miwa et al. ..... 439/752
6,152,783 * 11/2000 Tsuchiya ..... 439/752
6,173,488 * 1/2001 Endo et al. ..... 29/747

FOREIGN PATENT DOCUMENTS 06-58570 8/1994 (JP) .

* cited by examiner

*Primary Examiner*—Khiem Nguyen
*Assistant Examiner*—Thanh-Tam Le
(74) *Attorney, Agent, or Firm*—Armstrong Westerman, Hattori, McLeland & Naughton, LLP

(57) ABSTRACT

A double locking connector, in which a spacer can be completely inserted without hitting a terminal so as to secondarily lock the terminal securely under such condition that a lance for locking the terminal in a connector housing primarily locks the terminal, is provided. The double locking connector 1 includes: a connector housing 2 having a flexible lance 7 for primarily locking a terminal 4; and a spacer 6 for secondarily locking the terminal 4, which is inserted into the connector housing 2 at a right angle to a direction of inserting the terminal 4, wherein the lance 7 and the spacer 6 lock the same spot of the terminal 4. The same spot is a shoulder 11 at a midpoint along a longitudinal direction of the terminal 4. A projection 8 of the lance 7 and a protrusion 9 of the spacer 6 are disposed in parallel along a lateral direction of the terminal 4.

3 Claims, 6 Drawing Sheets

DOUBLE LOCKING CONNECTOR

BACKGROUND OF THE INVENTION

1. Field of the Invention

This invention relates to a connector that locks a terminal doubly by employing a locking lance of a connector housing and a spacer inserted into the connector housing and, more specifically, to the connector for locking a terminal doubly, wherein the lance and the spacer lock the same spot of the terminal.

2. Description of the Related Art

FIGS. 11 to 13 show a conventional double locking connector described in Japanese Utility Model Application Laid-Open No. H6-58570.

As shown in FIG. 11, the double locking connector 60 comprises: a male connector housing 61 made of synthetic resin; female terminals 64 each inserted from rear openings 62*a* of the connector housing 61 into terminal receiving chambers 62 (see FIG. 12); and a spacer 67 made of synthetic resin for locking the terminals 64 each inserted from opening 66 of walls 65 at the bottom of the connector housing 61 into the connector housing 61 at a right angle to a direction of inserting the terminal.

In the connector housing 61, there is formed a space 68 into which the spacer 67 is inserted. As for this conventional example of the double locking connector 60, two rows of the chambers 62 for receiving the terminals 64 are disposed vertically in the connecter housing 61 and each chamber 62 extends from the front of the connector housing 61 to the rear thereof with a space 68 for receiving the spacer 67 at a mid portion along the length thereof. A flexible lance (arm) 70 for primarily locking a terminal 64 is formed on an upper wall 69 of the chamber 62 and a projection 71 at the end of the lance 70 faces the chamber 62.

The terminal 64 is manufactured by punching out from a conductive metal plate followed by bending processing and has an electric contact 86 at the first half thereof and a pressure welding part 72 at the latter half thereof. A rectangular engaging hole 73 for receiving the projection 71 of the lance 70 is formed on an upper wall of the electric contact 86 and a pair of stabilizers 74 arises from both sides of the engaging hole 73. A spring (not shown in the figure) for contacting is inserted inside the electric contact 86. The pressure welding part 72 consists of a contact piece 72*a* to be pressure welded to conductors of the wire at the front portion thereof (see FIG. 12) and a clamping piece 72*b* to clamp an insulator of the wire at the rear portion thereof.

The spacer 67 comprises: a substrate 75 for closing the opening 66; a plurality of partitions 76 vertically arose from the substrate 75; a wall 77 for connecting upper ends of the partitions 76; a protrusion 78 for secondarily locking the terminals 64 formed in parallel on the wall 77; and a pair of locking walls 79 arose vertically from the substrate 75. Each part 80 of the respective chamber 62 is formed between the corresponding partitions 76. Each protrusion 78 has an inclined plane 78*a* on which an end of the terminal 64 slidably abuts. The locking wall 79 has a flexible claw 82 engaging with an engaging portion 81 of the connector housing 61.

As shown in FIG. 12, the terminal 64 is inserted into the terminal receiving chamber 62 under such condition that the spacer 67 is temporarily locked to the connector housing 61. The terminal 64 pushes down the protrusion 78 of the spacer 67 to bring the spacer 67 in a temporary locking state and is advanced by pushing up the lance 70.

As shown in FIG. 13, when the terminal 64 is completely inserted into the connecter housing 61, the lance 70 resiliently restores its original state and the projection 71 engages with the engaging hole 73 of the terminal 64, thereby the terminal 64 is primarily locked. Then, the spacer 67 is inserted in a direction shown by an arrow D of FIG. 13 and a front end of the projection 78 abuts on a shoulder (a rear end) 83 of the electric contact 86 of the terminal 64, thereby the terminal 64 is secondarily locked. That is, the terminal 64 is doubly locked by the lance 70 and the spacer 67, thereby the terminal 64 is securely prevented from coming off.

If the terminal 64 is incompletely inserted into the connecter housing 61, the protrusion 78 hits a bottom surface 84 (see FIG. 13) of, the electric contact 86 of the terminal 64 when the spacer 67 is inserted into the chamber 62, then the spacer 67 cannot be advanced any more, thereby the incomplete insertion of the terminal 64 can be detected by an operator.

However, as for the structure of the conventional double locking connector described above, if the position of the engaging hole 73 is shifted excessively to the front of the terminal 64 due to unevenness of the dimensions of the terminal 64 (based on the unevenness in manufacture thereof), the front end of the protrusion 78 of the spacer 67 abuts on the bottom surface 84 of the electric contact 86 of the terminal 64 even when the terminal 64 is completely inserted into the connecter housing 61, then the spacer 67 cannot be completely inserted, resulting in that the operator might mistakenly detect the state as an incomplete insertion of the terminal 64.

On the other hand, if the position of the engaging hole 73 is shifted excessively to the rear of the terminal 64, after the complete insertion of the terminal 64, the protrusion 78 of the spacer 67 engages with a shoulder (a rear end) 83 of the electric contact 86 of the terminal 64 to secondarily lock the terminal 64, however, the projection 71 of the lance 70 does not engage with the engaging hole 73 of the terminal 64, causing a problem that the terminal 64 cannot be locked primarily. In this case, the operator does not find a failure in the engagement of the lance 70, then the working process might be advanced to a next step leaving the terminal 64 to stay in such condition that the locking force of the terminal is weak.

Furthermore, if a length of the electric contact 86 is too long, even when the projection 71 of the lance 70 engages with the engaging hole 73 of the terminal 64 upon the complete insertion of the terminal 64, the protrusion 78 of the spacer 67 hits the electric contact 86 of the terminal 64. In this case, since the terminal is primarily locked by the lance 70, the terminal 64 cannot be come out even when the spacer 67 is come out and a wire 85 (see FIG. 13) connected to the terminal 64 is pulled. Then, such a time-consuming work is necessary that the engagement of the lance 70 is released by using a jig (not shown in the figure) and that the terminal 64 is replaced by another terminal.

SUMMARY OF THE INVENTION

It is therefore an objective of the present invention to solve the above problem and to provide a double locking connector that can doubly lock a terminal securely by a lance and a spacer for locking the terminal and securely prevent an error of detection upon the detection of an incomplete insertion of the terminal by the spacer, thereby the detection can be implemented accurately.

In order to attain the above objective, the present invention is to provide a double locking connector comprising: a connector housing having a flexible lance for primarily locking a terminal; and a spacer for secondarily locking the terminal, which is inserted into the connector housing at a right angle to a direction of inserting the terminal, wherein the lance and the spacer lock the same spot of the terminal.

The same spot is a shoulder at a midpoint along a longitudinal direction of the terminal.

A projection of the lance and a protrusion of the spacer are disposed in parallel along a lateral direction of the terminal.

DESCRIPTION OF THE PREFERRED EMBODIMENTS

Figure 1:
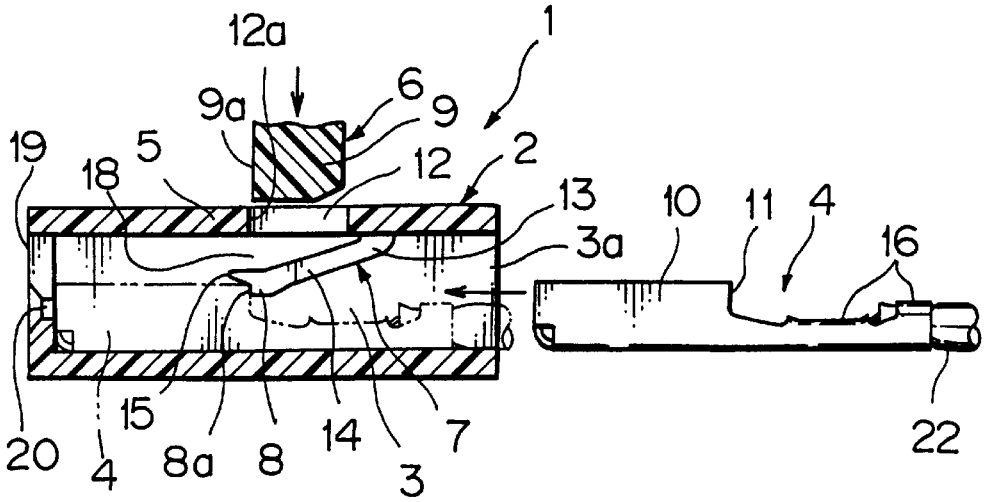
FIG. 1 is a longitudinal sectional view illustrating a double locking connector according to the present invention.
Figure 2:
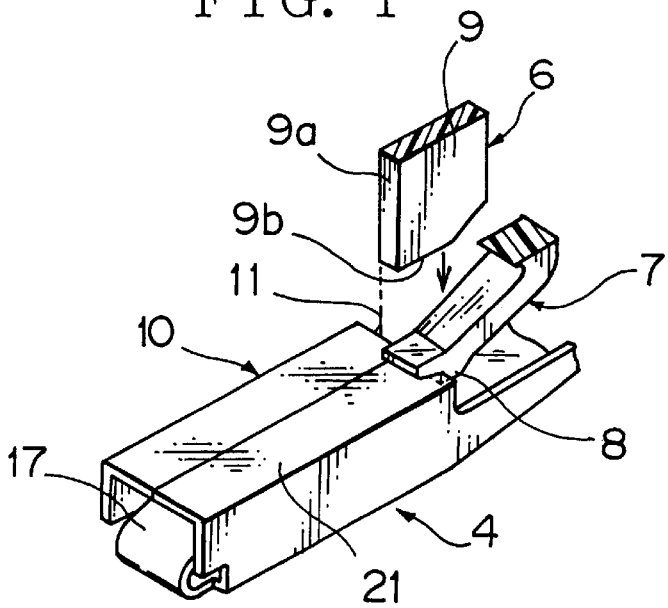
FIG. 2 is a perspective view illustrating how a terminal is doubly locked.

FIG. 1 is a longitudinal sectional view illustrating a double locking connector according to the present invention. FIG. 2 is a perspective view illustrating how a terminal is doubly locked.

As shown in FIG. 1, the double locking connector 1 comprises: a male connector housing 2 made of synthetic resin; female terminal 4 inserted from rear openings 3*a* of the connector housing 2 into a terminal receiving chamber 3; and a spacer 6 made of synthetic resin for locking the terminal 4 inserted from a top wall 5 of the connector housing 2 into the chamber 3 at a right angle to a direction of inserting the terminal, wherein a projection 8 of a lance 7 in the chamber 3 and a plate-shaped protrusion 9 of the spacer 6 are disposed in parallel so that a primary locking surface 8*a* at a front end of the projection 8 belongs to the same plane (i.e. common plane) with a secondary locking surface 9*a* at a front end of the protrusion 9, thereby the lance 7 and the spacer 6 together lock the same spot of the terminal 4, that is, a shoulder (a rear end) 11 of a box-shaped electric contact 10 of the terminal 4.

The connector housing 2 has an opening 12 for receiving the spacer 6 on the top wall 5, a root 13 of the flexible lance 7 is located at a rear of the opening 12, and the lance 7 is formed on the top wall 5 in one body with the connector housing 2. The lance 7 has the downward projection 8 at the front-end side of its straight part 14 and an extension 15 at the upper front of the projection 8. The projection 8 and the extension 15 are situated making a right angle with each other and abut against the shoulder (a rear end) 11 of a box-shaped electric contact 10 of the terminal 4 as shown in FIG. 2.

The lance 7 is eccentrically disposed in the cross direction of the terminal 4 and the projection 8 locks a left half of the electric contact 10 of the terminal 4. When the spacer 6 is inserted into the chamber 3, the protrusion 9 of the spacer 6 is adjacently situated to the right of the lance 7 and the protrusion 9 locks a right half of the electric contact 10 of the terminal 4. As mentioned above, the primary locking surface 8*a* at a front end of the projection 8 belongs to the same plane with the secondary locking surface 9*a* at a front end of the protrusion 9, thereby the projection 8 and the protrusion 9 each lock the shoulder (the rear end) 11 of the electric contact 10 of the terminal 4. In FIGS. 1 and 2, only the protrusion 9 of the spacer 6 is shown, but actually, as will be described later, a plurality of the protrusions 9 corresponding to a plurality of the terminals 4 protrude from a substrate (not shown in the figure).

The terminal 4 has the electric contact 10 at the first half and a pressure welding part 16 at the latter half (see FIG. 1) and also has a spring 17 (see FIG. 2) for contacting with respect to a male terminal (not shown in the figure) situated in an opposite (female) connector inside the electric contact 10. The electric contact 10 has no need to have an engaging hole formed in the terminal in the conventional double locking connector, thereby the structure of the terminal is simplified and a manufacturing cost thereof is reduced.

As shown in FIG. 1, a space 18 for the lance 7 to bend therewithin is given above the lance 7 and the opening 12 communicated with the space 18 is formed to receive the spacer 6. A front surface 12*a* of the opening 12 belongs to the same plane with the primary locking surface 8*a* of the projection 8 of the lance 7. The protrusion 9 of the spacer 6 is inserted along the front surface 12*a* of the opening 12. The shoulder (the rear end) 11 of the electric contact 10 of the terminal 4 that is completely inserted is situated right under the front surface 12*a* of the opening 12. An front end of the terminal 4 hits a front wall 19 of the connector housing 2 and stops there, thereby the terminal 4 is primarily locked by the lance 7.

A inserting hole 20 for receiving an opposite male terminal (not shown in the figure) is formed on the front wall 19 and a front end of the electric contact 10 of the terminal 4 is situated facing the inserting hole 20. When the spacer 6 is completely inserted into the chamber 3, the secondary locking surface 9*a* of the protrusion 9 abuts against the shoulder 11 of the electric contact 10 of the terminal 4 (that is, the secondary locking surface 9*a* is situated at the rear of the shoulder 11), thereby the terminal 4 is secondarily locked.

Figure 11:
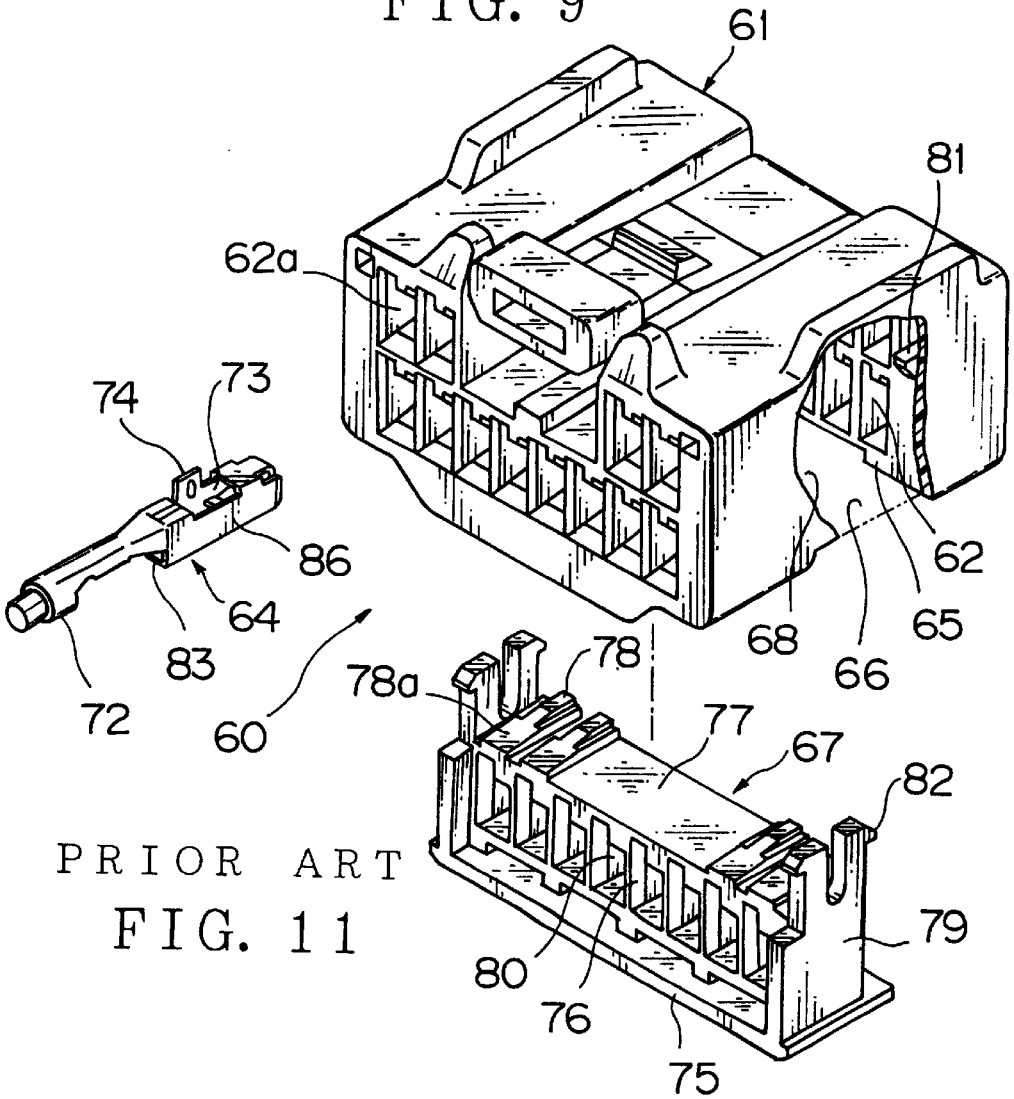
PRIOR ART FIG. 11
FIG. 11 is an exploded perspective view illustrating a conventional double locking connector.

As shown in FIG. 2, since the shoulder 11 of the electric contact 10 of the terminal 4 is doubly locked by the lance 7 and the spacer 6, the electric contact 10 has no need to have an engaging hole 73 formed in the terminal 64 in the conventional double locking connector 60 shown in FIG. 11, then a positional discrepancy of the terminal caused by that of the engaging hole never takes place, thereby the double locking by the lance 7 and the spacer 6 is securely implemented. Furthermore, when the terminal 4 is completely inserted, the spacer 6 is securely inserted without hitting the electric contact 10, thereby an error of the detection regarding the insertion of the terminal is securely prevented from occurring. When the terminal 4 is incompletely inserted, the spacer 6 hits the electric contact 10 so as to allow an operator to detect the incomplete insertion of the terminal 4. In addition, since the engaging hole is not necessary, the structure of the electric contact 10 becomes simple and the manufacture of the terminals becomes easy.

When a length of the electric contact 10 is too long, neither the projection 8 of the lance 7 nor the protrusion 9 of the spacer 6 can lock the shoulder 11 of the electric contact 10 (that is, cannot be situated at the rear of the shoulder 11), therefore, a front end 9*b* of the protrusion 9 of the spacer 6 hits a top surface 21 (see FIG. 2) of the electric contact 10, thereby an abnormality in locking of the terminal 4 can be securely detected (although, in this case, the abnormality is not an incomplete insertion of the terminal 4). In this case, the terminal 4 is easily taken off from the connector housing 2 by pulling out a wire 22 (see FIG. 1) connected to the terminal 4, then that the terminal 4 is not primarily locked can be easily detected.

FIGS. 3 to 10 illustrate a detailed structure of a preferred embodiment of the double locking connector according to the present invention. That a lance 26 of a connector housing 25 and a spacer 27 together lock an shoulder (a rear end) 30 of an electric contact 29 of a terminal 28 is the same with the preferred embodiment shown in FIGS. 1 and 2. In a double locking connector 24 according to the present preferred embodiment, an upper protrusion $\mathbf{31}_1$ and a lower protrusion $\mathbf{31}_2$ of the spacer 27 and an upper lance $\mathbf{26}_1$ and a lower lance $\mathbf{26}_2$ together lock the respective terminal 28 (only the upper terminal is shown in the figure) disposed in two rows upper and lower.

Figure 3:
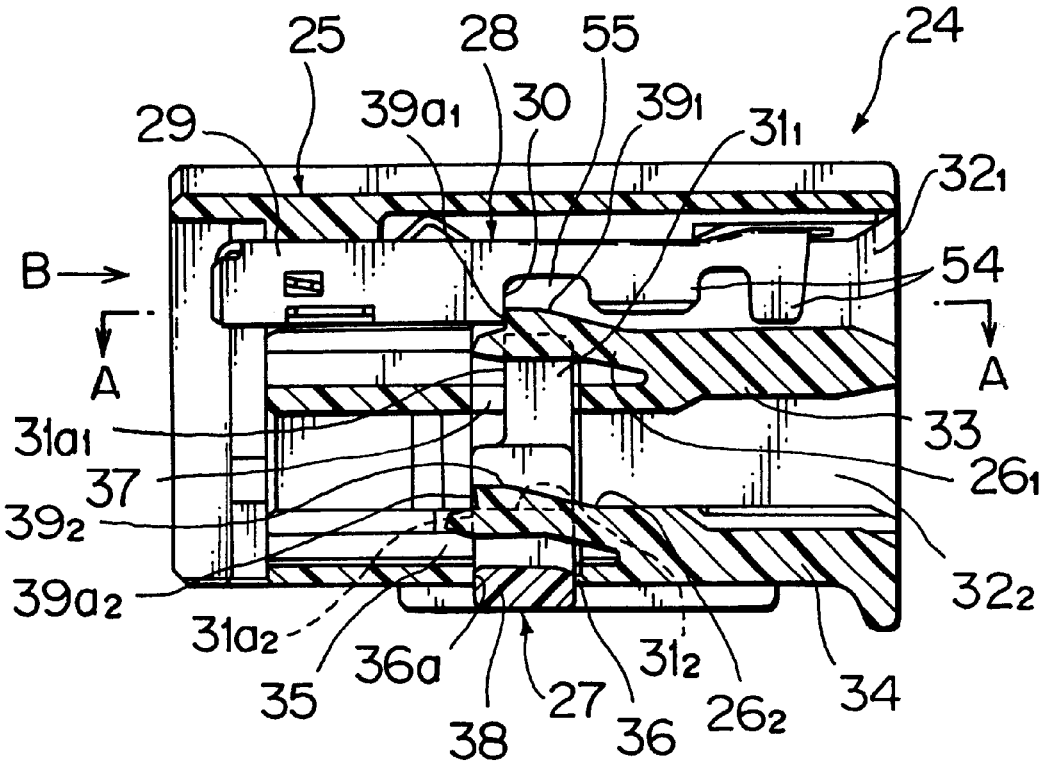
FIG. 3 is a longitudinal sectional view illustrating a preferred embodiment of a double locking connector according to the present invention.

As shown in FIG. 3, the connector housing 25 has an upper chamber $\mathbf{32}_1$ and a lower chamber $\mathbf{32}_2$ for receiving the terminal, wherein the lances $\mathbf{26}_1$ and $\mathbf{26}_2$ in the chambers $\mathbf{32}_1$ and $\mathbf{32}_2$, respectively, are relatively disposed front and rear with each other. That is, the lower lance $\mathbf{26}_2$ is situated in front of the upper lance $\mathbf{26}_1$. A terminal 28 having a long electric contact 29 is received in the upper chamber $\mathbf{32}_1$, while another terminal (not shown in the figure) having a short electric contact 29 is received in the lower chamber $\mathbf{32}_2$.

The upper lance $\mathbf{26}_1$ protrudes upward obliquely from a horizontal middle wall 33 of the connector housing 25, while the lower lance $\mathbf{26}_2$ protrudes likewise from a lower wall 34. In the vicinity of a space 35 for the lower lance $\mathbf{26}_2$ to bend therewithin, a lower opening 36 for inserting the spacer 27 therethrough is formed in the lower wall 34, while an upper opening 37 for inserting the upper protrusion $\mathbf{31}_1$ therethrough is formed in the middle wall 33.

The spacer 27 consists of a substrate 38 for a press-operation and the plate-shaped protrusions $\mathbf{31}_1$ and $\mathbf{31}_2$ having different width with each other and arose vertically from the substrate 38. The lower protrusion $\mathbf{31}_2$ advancing into the lower chamber $\mathbf{32}_2$ for receiving the terminal is formed to have a wide width in the front-and-rear direction of the connector housing (i.e. in the direction of inserting the terminal), while the upper protrusion $\mathbf{31}_1$ advancing into the upper chamber $\mathbf{32}_1$ for receiving the terminal is formed to have a narrow width in the front-and-rear direction of the connector housing. A front end surface $\mathbf{31}a_2$ of the lower protrusion $\mathbf{31}_2$, a front end surface $\mathbf{39}a_2$ of a lower projection $\mathbf{39}_2$ of the lower lance $\mathbf{26}_2$ and a front end surface 36*a* of the lower opening 36 belong to the same plane. A front-end surface $\mathbf{31}a_1$ of the upper protrusion $\mathbf{31}_1$ belongs to the same plane with a front-end surface $\mathbf{39}a_1$ of an upper projection $\mathbf{39}_1$ of the upper lance $\mathbf{26}_1$. A rear end surface of the upper protrusion $\mathbf{31}_1$ and that of the lower protrusion $\mathbf{31}_2$ belong to the same plane.

Figure 8:
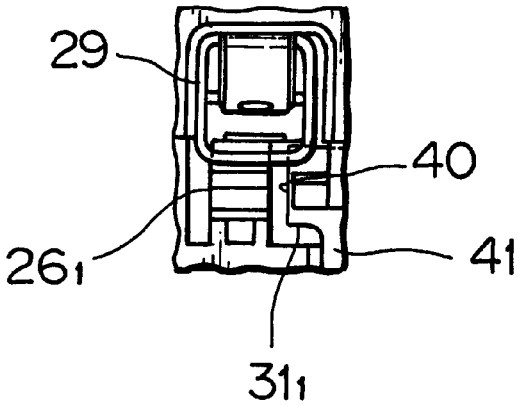
FIG. 8 is a front view illustrating the terminal in the secondarily locked state viewed from arrow C of FIG. 7.

For example, the upper protrusion $\mathbf{31}_1$ and the lower protrusion $\mathbf{31}_2$ are formed on the substrate 38 at right and left in parallel, responding to the upper chamber $\mathbf{32}_1$ and the lower chamber $\mathbf{32}_2$, respectively, which are relatively disposed front and rear with each other. Instead of the above construction, the narrow upper protrusion $\mathbf{31}_1$ and the wide lower protrusion $\mathbf{31}_2$ may be molded into one body, only a main portion 40 (a portion for locking the terminal) of the protrusions $\mathbf{31}_1$ and $\mathbf{31}_2$ is formed to be thick as shown in FIG. 8 and a portion 41 under the main portion 40 is formed to be thin so that the lower terminal can advance through just beside the portion 41 without any obstruction.

In FIG. 3, the spacer 27 is in a temporary locking state (also see FIG. 6), that is, not fully inserted. On this condition, each terminal 28 is inserted into the respective chamber $\mathbf{32}_1$ or $\mathbf{32}_2$. Each protrusion $\mathbf{31}_1$ and $\mathbf{31}_2$ of the spacer 27 is situated under the electric contact 29 of the respective terminal 28. As the terminal 28 is inserted, the lances $\mathbf{26}_1$ and $\mathbf{26}_2$ bend downward, then restore their original states upon the complete insertion of the terminals 28, that is, each of front end $\mathbf{39}a_1$ and $\mathbf{39}a_2$ of the projection of the lance abuts against the respective shoulder (rear end) 30 of the electric contact 29 of the terminal 28, thereby each terminal is primarily locked. A front holder (a front-end wall; not shown in the figure) is attached to the front end of the connector housing 25 so that a front end of the electric contact 29 abuts on the front holder.

Figure 4:
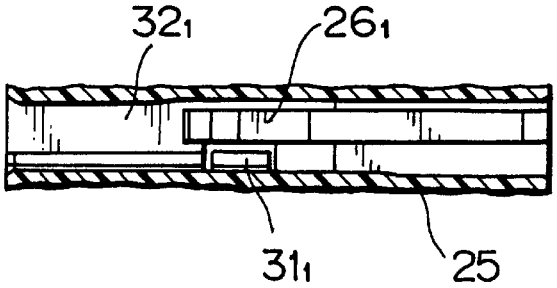
FIG. 4 is a sectional view illustrating a positional relation between a lance and a spacer each for locking a terminal taken along A—A line in FIG. 3.
Figure 5:
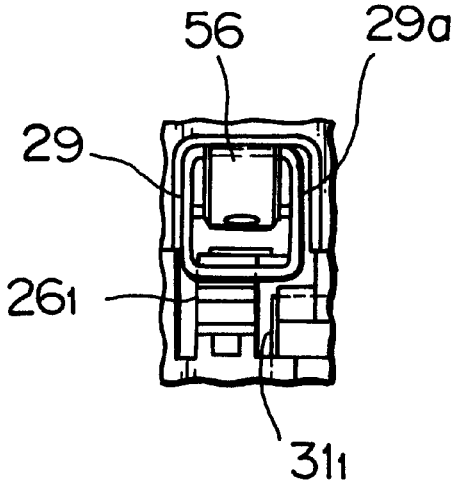
FIG. 5 is a front view illustrating the terminal in the primarily locked state viewed from arrow B of FIG. 3.

As shown in FIGS. 4 and 5, in the chamber $\mathbf{32}_1$ of the connector housing 25, the lance $\mathbf{26}_1$ and the protrusion $\mathbf{31}_1$ of the spacer 27 (see FIG. 3) are situated at right and left in parallel with each other in the cross direction of the terminal. The lance $\mathbf{26}_1$ is situated at the right half side of the terminal 28, while the protrusion $\mathbf{31}_1$ of the spacer 27 is situated at the left half side of the terminal 28. Strictly, as shown in FIG. 5, the lance $\mathbf{26}_1$ is situated passing over a central line of the electric contact 29 of the terminal 28, while the protrusion $\mathbf{31}_1$ is situated right under one side 29*a* of the electric contact 29. A width of the protrusion $\mathbf{31}_1$ is set to be a little narrower than that of the lance $\mathbf{26}_1$.

Figure 6:
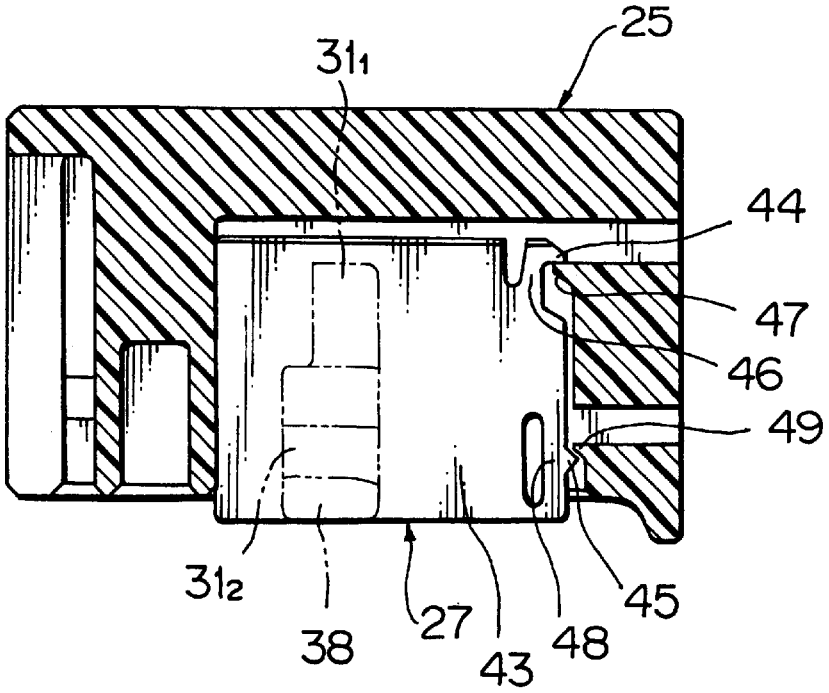
FIG. 6 is a longitudinal sectional view illustrating the spacer in a temporary locking state.

As shown in FIG. 6, the spacer 27 has a pair of locking walls 43 arose vertically from both sides of the substrate 38, wherein a temporary claw 44 and a permanent claw 45 are formed at the rear end of each locking wall 43. The temporary claw 44 is situated above the permanent claw 45. The temporary claw 44 is formed at a front end of an arm 46 and engages with a temporary prominence 47 of the connector housing 25. The permanent claw 45 is formed in the center of a flexible wall 48 being in contact with a lower surface of a permanent prominence 49 of the connector housing 25. On such a condition, the spacer 27 is temporarily locked to the connector housing 25.

Figure 7:
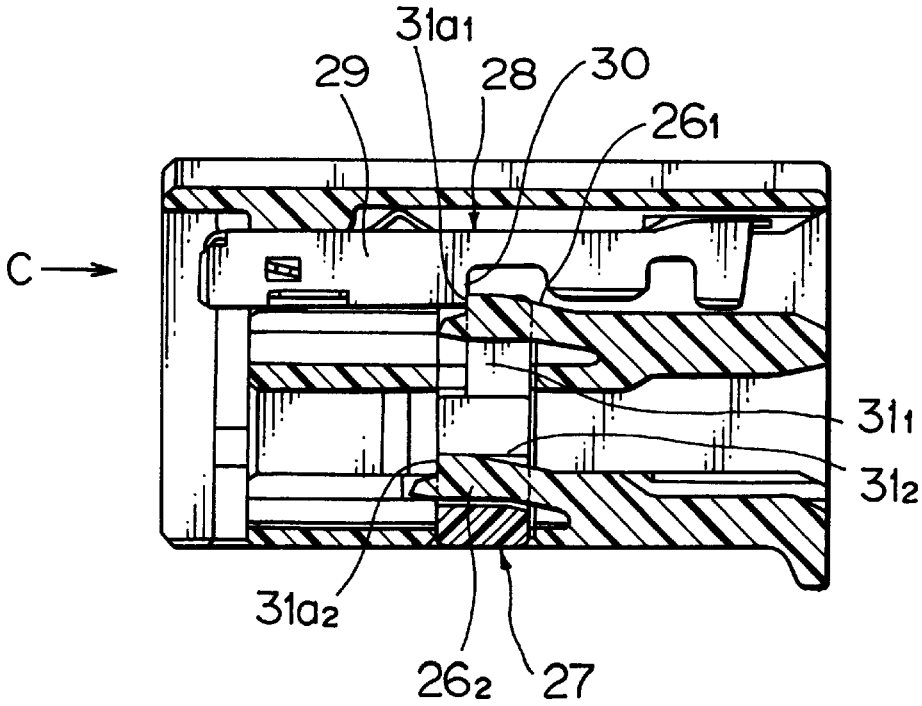
FIG. 7 is a longitudinal sectional view illustrating the terminal in the secondarily locked state.
Figure 9:
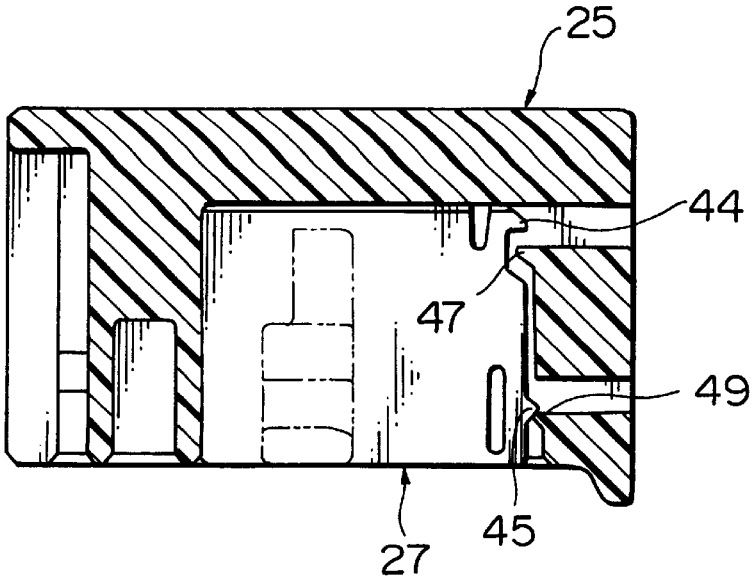
FIG. 9 is a longitudinal sectional view illustrating the spacer in the secondarily locked state.

When the spacer 27 is pressed upward, the spacer 27 is fully locked as shown in FIGS. 7 to 9, at the same time, the terminals 28 are secondarily locked by the protrusions $\mathbf{31}_1$ and $\mathbf{31}_2$ of the spacer 27. That is, each of the front enda $\mathbf{31}a_1$ and $\mathbf{31}a_2$ of the protrusion abuts against the respective shoulder (rear end) 30 of the electric contact 29 of the terminal. (Only the upper terminal is shown in FIG. 7.) As shown in FIG. 8, the protrusion $\mathbf{31}_1$ arises at the side of the lance $\mathbf{26}_1$ to abut against the shoulder 30 of the electric contact 29 of the terminal 28. As shown in FIG. 9, the temporary claw 44 of the spacer 27 is apart from the temporary prominence 47 of the connector housing 25, while the permanent claw 45 passes over the permanent prominence 49 and engages with an upper portion of the permanent prominence 49.

Figure 10:
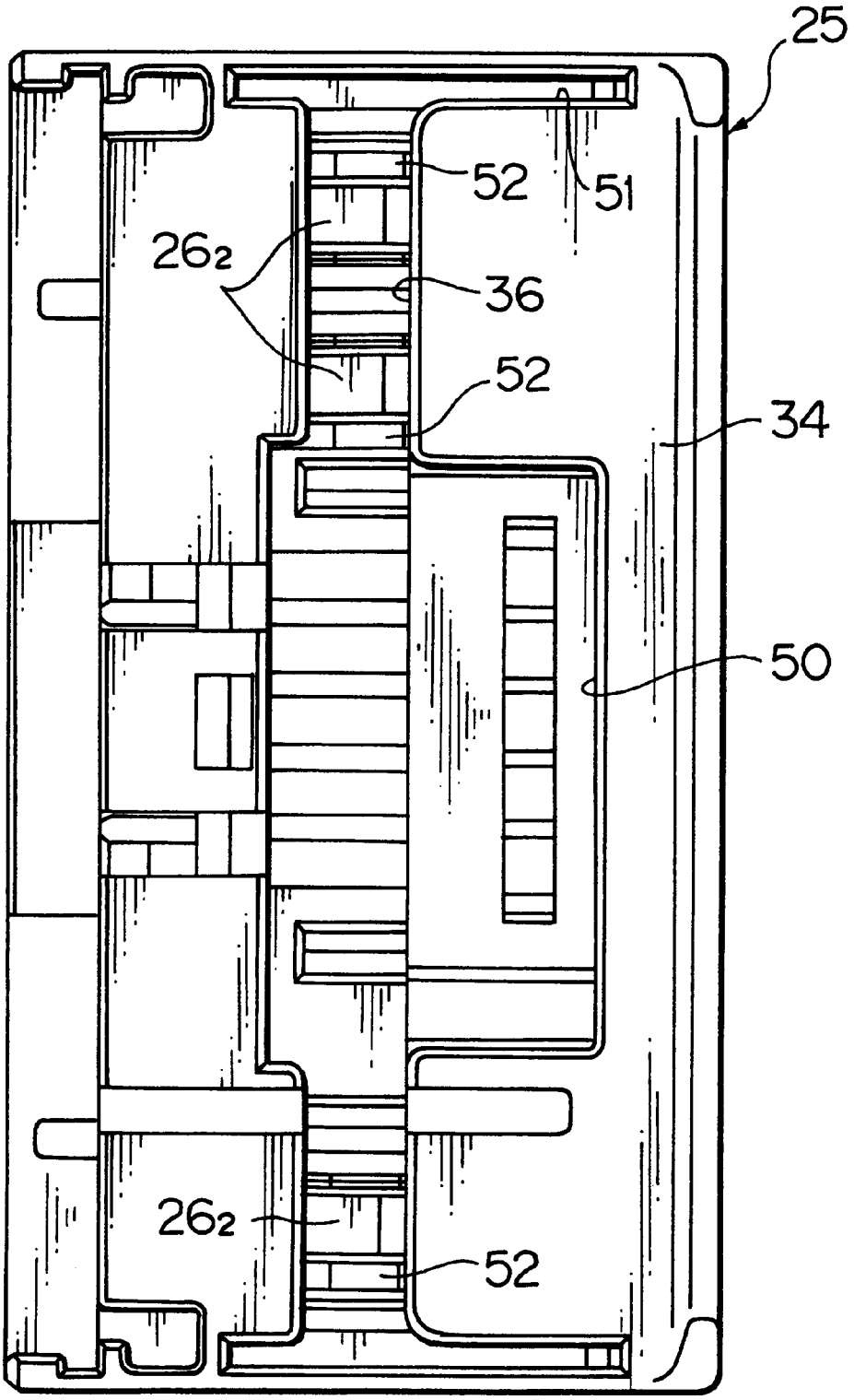
FIG. 10 is a bottom view illustrating a connector housing.
Figure 12:
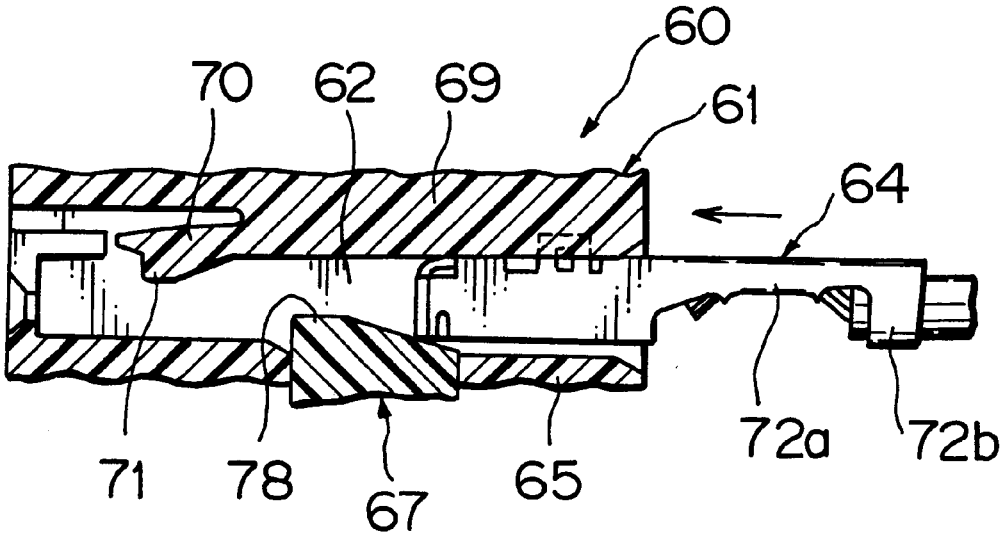
PRIOR ART FIG. 12
FIG. 12 is a longitudinal sectional view illustrating a state in which the terminal is on the way of insertion into a connector housing.
Figure 13:
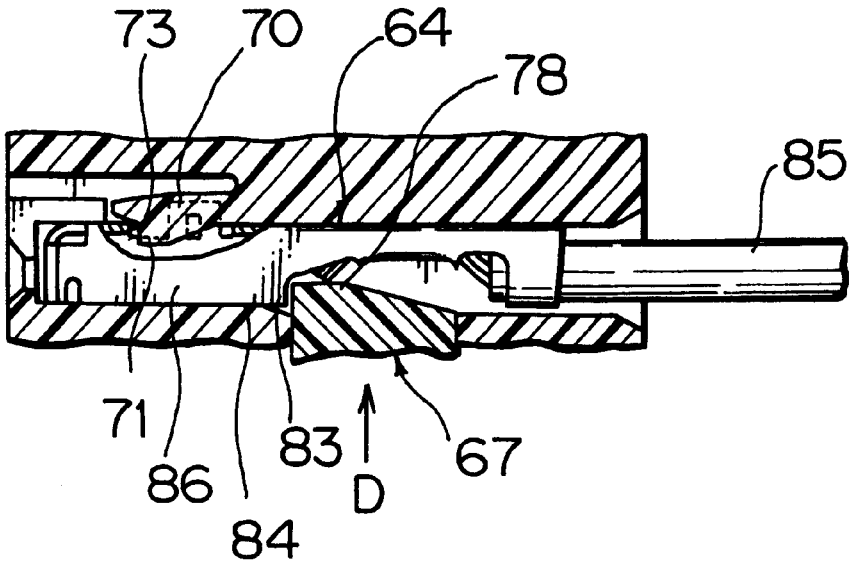
PRIOR ART FIG. 13
FIG. 13 is a longitudinal sectional view illustrating the terminal in a doubly locked state.

FIG. 10 is a bottom view illustrating the connector housing 25. Openings 36, 50 and 51 for inserting the substrate 38 of the spacer 27 and a pair of the locking walls 43 (see FIG. 6) therethrough are formed in a bottom wall of the connector housing 25 and slit-shaped holes 52 for inserting the lower protrusion $\mathbf{31}_2$ of the spacer 27 are formed adjacently to each lower lance $\mathbf{26}_2$. Each hole 52 is situated adjacently at right or left of the lower lance $\mathbf{26}_2$.

The opening 50 is widely formed and the openings 51 at both sides are further widely formed. Since the locking walls 43 (see FIG. 6) are widely formed, the spacer 27 can be stably inserted into the connector housing 25. In addition, since a situation of the lower lances $\mathbf{26}_2$ can be seen from the opening 36, a situation of a primary locking of the terminals 28 can be confirmed visually.

According to the preferred embodiment described above, the lances $\mathbf{26}_1$ and $\mathbf{26}_2$ and the protrusions $\mathbf{31}_1$ and $\mathbf{31}_2$ of the spacer 27 are disposed in parallel at the middle of the connector housing 25 so that the same spot, i.e. the shoulder 30 of the electric contact 29 of the terminal 28 is doubly locked, therefore, the engaging hole of the terminal that has been required in the conventional double locking connector is not needed any more and a positional discrepancy of the terminal caused by that of the engaging hole never takes place, thereby the double locking by the lances $\mathbf{26}_1$ and $\mathbf{26}_2$ and the spacer 27 can be securely implemented. In addition, the spacer 27 can be securely inserted without hitting the electric contact 29 of the terminal 28 upon the full insertion of the terminal 28, therefore, an error of detection for the insertion of the terminal 28 can be securely prevented. While, upon the incomplete insertion of the terminal 28, the spacer 27 hits the electric contact 29, thereby the incomplete insertion of the terminal 28 can be securely detected.

Furthermore, since the lances $\mathbf{26}_1$ and $\mathbf{26}_2$ and the protrusions $\mathbf{31}_1$ and $\mathbf{31}_2$ of the spacer 27 are not disposed at back and front of the connector housing 25, but disposed in parallel in the cross direction of the terminal at the middle portion of the connector housing 25, therefore, the lances $\mathbf{26}_1$ and $\mathbf{26}_2$ can be disposed by utilizing a space 55 (see FIG. 3) at the side of a pressure welding part 54 (see FIG. 3) of the terminal 28. Compared with the box-shaped electric contact 29, the pressure welding part 54 having short height gives a large space including the space 55. Consequently, the double locking connector can be miniaturized in the direction of its height. In addition, the length of the lances $\mathbf{26}_1$ and $\mathbf{26}_2$ can be set longer than that of the conventional double locking connector, thereby a degree of freedom in designing a resilient force or amount of bending of the lances $\mathbf{26}_1$ and $\mathbf{26}_2$ is increased.

In the preferred embodiments described above, examples of the double locking connector 24, in which the female terminal 28 having the box-shaped electric contact 29 containing a spring 56 (see FIG. 5) for contacting therein and the male connector housing 25 for receiving the terminal 28, is described. The described structure, in which the lances $\mathbf{26}_1$ and $\mathbf{26}_2$ and spacer 27 together lock the same spot of the terminal 28, can be applied to a double locking connector, in which a male terminal having a tab for electric contact and a box-shaped part situated at the rear of the tab is received into a female connector housing. In such a case, a shoulder (a rear end) of the box-shaped part is locked by a lance and a spacer in a similar manner as described above.

The aforementioned preferred embodiments are described to aid in understanding the present invention and variations may be made by one skilled in the art without departing from the spirit and scope of the present invention.

In comparison with the conventional double locking connector in which the terminal is locked at two spots, since the lance and the spacer lock the same spot of the terminal in the double locking connector according to the present invention, therefore, a cumulative error in the positional accuracy with respect to a locking spot of the terminal does not exist, thereby the double locking of the terminal is securely implemented. That is, the spacer never hits the terminal upon the complete insertion of the terminal, thereby an error of detection for the insertion of the terminal can be securely prevented. Furthermore, even if the terminal is not locked by the lance, the terminal is neither locked by the spacer, thereby a failure in the locking of the terminal is securely detected by the incomplete insertion of the spacer.

In comparison with the conventional double locking connector in which the lance engages with the engaging hole of the terminal, since the same spot is a shoulder at a midpoint along the length of the terminal in the double locking connector according to the present invention, therefore, the lance can easily and securely be engaged with the shoulder and the spacer can also be securely engaged. In addition, the engaging hole of the terminal that has been required in the conventional double locking connector is not needed, therefore, the structure of the terminal is simplified, a manufacturing cost thereof is reduced, and a degree of freedom in designing a shape of the terminal is increased.

A projection of the lance and a protrusion of the spacer are disposed in parallel in the cross direction of the terminal in the double locking connector according to the present invention, therefore, the locking structure is miniaturized and the double locking connector can be miniaturized as well.

What is claimed is:

1. A double locking connector comprising:

a connector housing having a flexible lance for primarily locking a terminal; and a spacer for secondarily locking the terminal, which is inserted into the connector housing at a right angle to a direction of inserting the terminal, wherein the lance and the spacer engage and lock the terminal at locations which are the same distance, in a longitudinal direction of the terminal, from an end of the terminal.

2. The double locking connector according to claim 1, wherein the locations are on a shoulder at a midpoint along the longitudinal direction of the terminal.

3. The double locking connector according to claim 1 or 2, wherein a projection of the lance and a protrusion of the spacer are disposed in parallel along a lateral direction of the terminal.

* * * * *